US010156228B2

(12) United States Patent
Oikawa

(10) Patent No.: US 10,156,228 B2
(45) Date of Patent: Dec. 18, 2018

(54) CRYOPUMP AND METHOD FOR REGENERATING THE CRYOPUMP

(71) Applicant: Sumitomo Heavy Industries, Ltd., Tokyo (JP)

(72) Inventor: Ken Oikawa, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 531 days.

(21) Appl. No.: 14/660,237

(22) Filed: Mar. 17, 2015

(65) Prior Publication Data

US 2015/0267693 A1 Sep. 24, 2015

(30) Foreign Application Priority Data

Mar. 18, 2014 (JP) ..... 2014-054441

(51) Int. Cl.
*F04B 37/08* (2006.01)
*F25B 9/00* (2006.01)

(52) U.S. Cl.
CPC ..... *F04B 37/085* (2013.01); *F17C 2250/03* (2013.01); *F17C 2250/043* (2013.01); *F17C 2250/06* (2013.01); *F17C 2250/0631* (2013.01); *F25B 9/00* (2013.01)

(58) Field of Classification Search
CPC .... F04B 37/08; F04B 37/085; F17C 2205/03; F17C 2205/0332; F17C 2205/0382; F17C 2205/0326; B01D 8/00; G05B 2219/2654; F25B 9/10; F25B 9/14; F25B 9/145; F25B 9/00
See application file for complete search history.

(56) References Cited

U.S. PATENT DOCUMENTS 5,375,424 A 12/1994 Bartlett et al.
5,517,823 A * 5/1996 Andeen ..... F04B 37/085 417/901
5,582,017 A 12/1996 Noji et al.
5,862,671 A * 1/1999 Lessard ..... F04B 37/085 417/901
5,879,467 A * 3/1999 Zhou ..... B08B 9/08 134/19
8,302,409 B2 11/2012 Fukuda
2007/0125112 A1 6/2007 Tsuyuki
2009/0165470 A1* 7/2009 Aoki ..... F04B 37/085 62/55.5

(Continued)

FOREIGN PATENT DOCUMENTS

JP H02-252982 A 10/1990
JP H06-154505 A 6/1994

(Continued)

*Primary Examiner* — Frantz Jules
*Assistant Examiner* — Erik Mendoza-Wilkenfeld
(74) *Attorney, Agent, or Firm* — Michael Best & Friedrich LLP

(57) ABSTRACT

A method of regenerating a cryopump includes: supplying a purge gas to a cryopump in order to heat a cryopanel to a first temperature zone higher than the melting point of water; suspending supply of the purge gas to the cryopump while a cryopanel temperature is in the first temperature zone, and heating the cryopanel from the first temperature zone to a second temperature zone higher than a purge gas temperature.

11 Claims, 4 Drawing Sheets

(56) References Cited

U.S. PATENT DOCUMENTS

| | | | | |
|---|---|---|---|---|
| 2011/0162391 | A1* | 7/2011 | Ball-DiFazio | F04B 37/08 62/55.5 |
| 2012/0317999 | A1* | 12/2012 | Koyama | F04B 37/08 62/55.5 |
| 2013/0219924 | A1 | 8/2013 | Fukuda | |

FOREIGN PATENT DOCUMENTS

| | | | |
|---|---|---|---|
| JP | H07-208332 | A | 8/1995 |
| JP | 2000-512703 | A | 9/2000 |
| JP | 2001-123951 | A | 5/2001 |
| JP | 2013-170568 | A | 9/2013 |
| WO | WO-97/35111 | A1 | 9/1997 |

* cited by examiner

CRYOPUMP AND METHOD FOR REGENERATING THE CRYOPUMP

RELATED APPLICATION

Priority is claimed to Japanese Patent Application No. 2014-54441, filed on Mar. 18, 2014, the entire content of which is incorporated herein by reference.

BACKGROUND OF THE INVENTION

1. Field of the Invention

The present invention relates to a cryopump and a method for regenerating the cryopump.

2. Description of the Related Art

A cryopump is a vacuum pump that traps and pumps gas molecules by condensing or adsorbing them on cryopanels cooled to ultracold temperatures. The cryopump is generally used to attain a clean vacuum environment required for a semiconductor circuit manufacturing process, for instance. The cryopump, which is a so-called entrapment vacuum pump, needs regeneration by which the trapped gas is periodically released to the outside.

SUMMARY OF THE INVENTION

An exemplary purpose of an embodiment of the present invention is to raise the temperature of the cryopump efficiently in a cryopump regeneration.

According to an embodiment of the present invention, there is provided a cryopump comprising: a cryopanel; a cryopump housing arranged to enclose the cryopanel; a purge valve connected to the cryopump housing to supply a purge gas to the cryopump housing; a heat source that heats the cryopanel, the heat source being different from the purge gas; and a control unit that controls regeneration of the cryopump. The control unit opens the purge valve to supply the purge gas to the cryopump housing in order to heat the cryopanel to a first temperature zone higher than the melting point of water. The control unit closes the purge valve to suspend supply of the purge gas to the cryopump housing while a cryopanel temperature is in the first temperature zone. The control unit controls the heat source to heat the cryopanel from the first temperature zone to a second temperature zone higher than a purge gas temperature.

According to an embodiment of the present invention, there is provided a method of regenerating a cryopump. The method includes supplying a purge gas to a cryopump in order to heat a cryopanel to a first temperature zone higher than the melting point of water; suspending supply of the purge gas to the cryopump while a cryopanel temperature is in the first temperature zone, and heating the cryopanel from the first temperature zone to a second temperature zone higher than a purge gas temperature.

BRIEF DESCRIPTION OF THE DRAWINGS

Embodiments will now be described, by way of example only, with reference to the accompanying drawings, which are meant to be exemplary, not limiting, and wherein like elements are numbered alike in several figures, in which.

DETAILED DESCRIPTION OF THE INVENTION

The invention will now be described by reference to the preferred embodiments. This does not intend to limit the scope of the present invention, but to exemplify the invention.

A detailed description of an embodiment to implement the present invention will be given with reference to the drawings. Like numerals are used in the description to denote like elements and the description is omitted as appropriate. The structure described below is by way of example only and does not limit the scope of the present invention.

Figure 1:
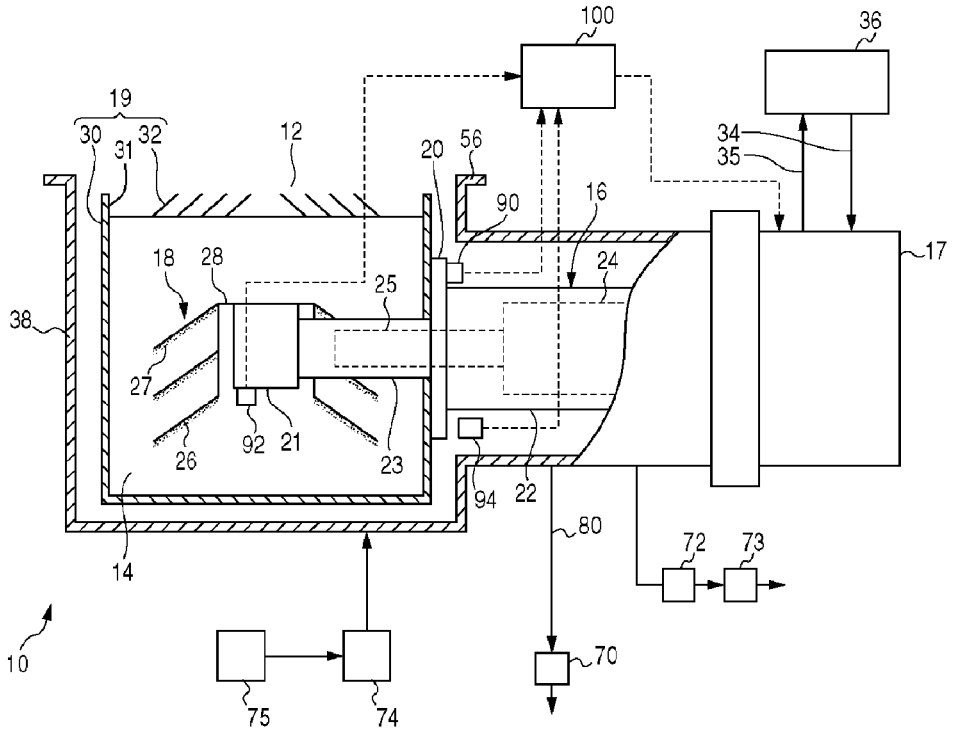
FIG. 1 is a schematic diagram showing a cryopump according to an embodiment of the present invention.

FIG. 1 is a schematic view illustrating a cryopump 10 according to an embodiment of the present invention. The cryopump 10, which is mounted, for example, to a vacuum chamber such as an ion implantation apparatus or a sputtering apparatus, is used to raise the degree of vacuum inside the vacuum chamber to a level required of a desired process.

The cryopump 10 has an inlet 12 for receiving a gas. The inlet 12 is an entrance to an internal space 14 of the cryopump 10. A gas to be pumped enters the internal space 14 of the cryopump 10 through the inlet 12 from the vacuum chamber to which the cryopump 10 is mounted.

It is to be noted that the terms "axial direction" and "radial direction" may be used in the following description to clearly show the positional relationships between the constituent parts of the cryopump 10. The axial direction represents a direction passing through the inlet 12, whereas the radial direction represents a direction along the inlet 12. For convenience, with respect to the axial direction, positions relatively closer to the inlet 12 may be described as "above", and positions relatively farther from the inlet 12 as "below". That is, positions relatively farther from the bottom of the cryopump 10 may be described as "above", and positions relatively closer thereto as "below". With respect to the radial direction, positions closer to the center of the inlet 12 may be described as "inside", and positions closer to the periphery of the inlet 12 as "outside". However, it is to be noted that these descriptions do not limit to a specific location and/or orientation of the cryopump 10 as mounted to the vacuum chamber. For example, the cryopump 10 may be mounted to the vacuum chamber with the inlet 12 facing downward in the vertical direction.

The cryopump 10 includes a low-temperature cryopanel 18 and a high-temperature cryopanel 19. Further, the cryopump 10 includes a cooling system configured to cool the high-temperature cryopanel 19 and the low-temperature cryopanel 18. The cooling system includes a refrigerator 16 and a compressor 36.

The refrigerator 16 is a cryogenic refrigerator, such as, for example, a Gifford-McMahon refrigerator (so-called GM refrigerator). The refrigerator 16 is a two-stage type refrigerator including a first stage 20, a second stage 21, a first cylinder 22, a second cylinder 23, a first displacer 24, and a second displacer 25. Accordingly, the high-temperature stage of the refrigerator 16 includes the first stage 20, the first cylinder 22, and the first displacer 24. The low-temperature stage of the refrigerator 16 includes the second stage 21, the second cylinder 23, and the second displacer 25.

The first cylinder 22 and the second cylinder 23 are connected in series. The first stage 20 is installed in a joint portion between the first cylinder 22 and the second cylinder 23. The second cylinder 23 connects the first stage 20 and the second stage 21. The second stage 21 is installed at the end of the second cylinder 23. The first displacer 24 and the second displacer 25 are arranged inside the first cylinder 22 and the second cylinder 23, respectively, so as to be movable in the longitudinal direction of the refrigerator 16 (the horizontal direction in FIG. 1). The first displacer 24 and the second displacer 25 are connected together so as to be movable integrally. A first regenerator and a second regenerator (not illustrated) are installed within the first displacer 24 and the second displacer 25, respectively.

The refrigerator 16 includes a drive mechanism 17 provided at the high-temperature end of the first cylinder 22. The drive mechanism 17 is connected to the first displacer 24 and the second displacer 25 such that the first displacer 24 and the second displacer 25 can be moved in a reciprocal manner inside the first cylinder 22 and the second cylinder 23, respectively. The drive mechanism 17 includes a flow channel switching mechanism that switches the flow channels of an operating gas such that intake and discharge of the gas are periodically repeated. The flow channel switching mechanism includes, for example, a valve unit and a drive unit for driving the valve unit. The valve unit includes, for example, a rotary valve, and the drive unit includes a motor for rotating the rotary valve. The motor may be, for example, an AC motor or a DC motor. The flow channel switching mechanism may be a mechanism of a direct acting type that is driven by a linear motor.

The refrigerator 16 is connected to the compressor 36 via a high-pressure conduit 34 and a low-pressure conduit 35. The refrigerator 16 generates cold on the first stage 20 and the second stage 21 by expanding, in the inside thereof, the high-pressure operating gas (e.g., helium) supplied from the compressor 36. The compressor 36 recovers the operating gas that has been expanded in the refrigerator 16, and increases the pressure thereof again to supply to the refrigerator 16.

More specifically, the drive mechanism 17 first communicates the high-pressure conduit 34 with the internal space of the refrigerator 16. The high-pressure operating gas is supplied from the compressor 36 to the refrigerator 16 through the high-pressure conduit 34. When the internal space of the refrigerator 16 is filled with the high-pressure operating gas, the drive mechanism 17 switches the flow channel so as to communicate the internal space of the refrigerator 16 with the low-pressure conduit 35. Thereby, the operating gas is expanded. The expanded operating gas is recovered into the compressor 36. In synchronization with such supply and discharge of the operating gas, the first displacer 24 and the second displacer 25 move in a reciprocal manner inside the first cylinder 22 and the second cylinder 23, respectively. The refrigerator 16 generates cold on the first stage 20 and the second stage 21 by repeating such heat cycles.

The refrigerator 16 is configured to cool the first stage 20 to a first temperature level and the second stage 21 to a second temperature level. The second temperature level is lower than the first temperature level. For example, the first stage 20 is cooled to approximately 65 K to 120 K, and preferably to 80 K to 100 K, whereas the second stage 21 is cooled to approximately 10 K to 20 K.

FIG. 1 illustrates a section including both of the central axis of the internal space 14 of the cryopump 10 and the central axis of the refrigerator 16. The cryopump 10 illustrated therein is a so-called horizontal cryopump. The horizontal cryopump generally means a cryopump in which the refrigerator 16 is so arranged as to intersect (normally intersect perpendicularly) with the central axis of the internal space 14 of the cryopump 10. Similarly, the present invention is applicable also to a so-called vertical cryopump. The vertical cryopump means a cryopump in which a refrigerator is arranged along the axial direction of the cryopump.

The low-temperature cryopanel 18 is provided in the central portion of the internal space 14 of the cryopump 10. The low-temperature cryopanel 18 includes, for example, a plurality of panel members 26. Each of the panel members 26 has, for example, the shape of a side surface of a truncated cone, so to speak, an umbrella-like shape. An adsorbent 27, such as activated carbon, is normally provided on each panel member 26. The adsorbent 27 is, for example, adhered to the rear surface of the panel member 26. Thus, the low-temperature cryopanel 18 includes an adsorption region for adsorbing gas molecules.

The panel members 26 are mounted to a panel mounting member 28. The panel mounting member 28 is mounted to the second stage 21. Thus, the low-temperature cryopanel 18 is thermally connected to the second stage 21. Accordingly, the low-temperature cryopanel 18 is cooled to the second temperature level.

The high-temperature cryopanel 19 includes a radiation shield 30 and an inlet cryopanel 32. The high-temperature cryopanel 19 is provided outside the low-temperature cryopanel 18 so as to surround the low-temperature cryopanel 18. The high-temperature cryopanel 19 is thermally connected to the first stage 20, and accordingly the high-temperature cryopanel 19 is cooled to the first temperature level.

The radiation shield 30 is provided mainly for protecting the low-temperature cryopanel 18 from the radiant heat from a housing 38 of the cryopump 10. The radiation shield 30 is located between the housing 38 and the low-temperature cryopanel 18 and encloses the low-temperature cryopanel 18. The axial upper end of the radiation shield 30 is opened toward the inlet 12. The radiation shield 30 has a tubular shape (e.g., cylindrical shape) whose axial lower end is closed, and is formed into a cup-like shape. A hole for mounting the refrigerator 16 is provided on a side surface of the radiation shield 30, and the second stage 21 is inserted into the radiation shield 30 therefrom. The first stage 20 is fixed, at the outer circumferential portion of the mounting hole, to the external surface of the radiation shield 30. Thus, the radiation shield 30 is thermally connected to the first stage 20.

The inlet cryopanel 32 is provided along the radial direction on the inlet 12. The inlet cryopanel 32 is disposed on a shield open end 31. The inlet cryopanel 32, with its outer periphery secured to the shield open end 31, is thermally coupled to the radiation shield 30. The inlet cryopanel 32 is provided axially above the low-temperature cryopanel 18. The inlet cryopanel 32 is formed into a louver structure or a chevron structure, for instance. The inlet cryopanel 32 may be formed concentrically with the central axis of the radiation shield 30 or may be formed into a grid-like or any other shape.

The inlet cryopanel 32 is provided for pumping a gas entering the inlet 12. A gas that condenses at the temperature of the inlet cryopanel 32 (e.g., moisture) is captured on the surface of the inlet cryopanel 32. The inlet cryopanel 32 is provided also for protecting the low-temperature cryopanel 18 from the radiation heat from a heat source outside the cryopump 10 (e.g., a heat source inside the vacuum chamber to which the cryopump 10 is mounted). The inlet cryopanel 32 also restricts the entry of not only the radiation heat but also gas molecules. The inlet cryopanel 32 occupies part of the opening area of the inlet 12, thereby limiting the entry of a gas into the internal space 14 through the inlet 12 to a desired amount.

The cryopump 10 is provided with the housing 38. The housing 38 is a vacuum vessel separating the inside of the cryopump 10 from the outside. The housing 38 is so configured as to airtightly maintain the pressure inside the internal space 14 of the cryopump 10. The housing 38, which is provided outside the high-temperature cryopanel 19, encloses the high-temperature cryopanel 19. Also, the housing 38 has the refrigerator 16 therewithin. In other words, the housing 38 is a cryopump housing enclosing the high-temperature cryopanel 19 and the low-temperature cryopanel 18.

The housing 38 is fixed to a portion having the ambient temperature (e.g., a high-temperature part of the refrigerator 16) in such a manner that the housing 38 does not touch the high-temperature cryopanel 19 and a low-temperature part of the refrigerator 16. The external surface of the housing 38, which is exposed to the outside environment, has a temperature higher than that of the cooled high-temperature cryopanel 19 (e.g., approximately room temperature).

Also, the housing 38 has an inlet flange 56 extending radially outward from the opening end thereof. The inlet flange 56 serves as a flange by which to mount the cryopump 10 to the vacuum chamber. A gate valve (not shown) is provided at the opening of the vacuum chamber, and the inlet flange 56 is attached to the gate valve. Therefore, the gate valve is located axially above the inlet cryopanel 32. The gate valve may be closed when the cryopump 10 is regenerated, and the gate valve may be opened when the vacuum chamber is evacuated by the cryopump 10.

A vent valve 70, a rough valve 72, and a purge valve 74 are connected to the housing 38.

The vent valve 70 is provided at one end of an exhaust line 80 for exhausting fluid from the internal space of the cryopump 10 to an external environment, for instance. Opening the vent valve 70 permits the flow of the exhaust line 80, whereas closing the vent valve 70 blocks the flow of the exhaust line 80. Though fluid to be discharged through the vent valve 70 is basically a gas, it may be liquid or a mixture of liquid and gas. For example, liquefied gas that has been condensed by the cryopump 10 may be mixed in the fluid to be discharged. By opening the vent valve 70, a positive pressure occurring within the housing 38 can be released to the outside.

The rough valve 72 is connected to a roughing pump 73. By opening or closing the rough valve 72, the roughing pump 73 and the cryopump 10 communicate with each other or are cut off from each other. Opening the rough valve 72 has the roughing pump 73 and the housing 38 communicate with each other. Closing the rough valve 72 cuts off the passage between the roughing pump 73 and the housing 38. By opening the rough valve 72 and operating the roughing pump 73, the inside of the cryopump 10 can be depressurized.

The roughing pump 73 is a vacuum pump for vacuum pumping of the cryopump 10. The roughing pump 73 is a vacuum pump configured to provide a base pressure zone or base pressure level of the cryopump 10. The base pressure zone covers a low-vacuum region in the workable pressure range of the cryopump 10. The base pressure zone includes an operation start pressure of the cryopump 10. The roughing pump 73 is capable of depressurizing the housing 38 from the atmospheric pressure to the base pressure zone. The base pressure zone covers a high-vacuum region of the roughing pump 73. Accordingly, the base pressure zone is included in an overlapped portion between the workable pressure range of the roughing pump 73 and that of the cryopump 10. For example, the base pressure zone is in the range of 1 Pa to 50 Pa, both inclusive. For example, the base pressure zone is on the order of 10 Pa.

Typically, the roughing pump 73 is provided as a vacuum device separate from the cryopump 10. For example, the roughing pump 73 constitutes a part of a vacuum system that includes the vacuum chamber to which the cryopump 10 is connected. The cryopump 10 is a main pump for the vacuum chamber and the roughing pump 73 is an auxiliary pump.

The purge valve 74 is connected to a purge gas supplier including a purge gas source 75. By opening or closing the purge valve 74, the purge gas source 75 and the cryopump 10 communicate with each other or are cut off from each other. Supply of the purge gas to the cryopump 10 is controlled accordingly. The flow of the purge gas from the purge gas source 75 to the housing 38 is permitted by opening the purge valve 74. The flow of the purge gas from the purge gas source 75 to the housing 38 is cut off by closing the purge valve 74. By opening the purge valve 74 and introducing the purge gas from the purge gas source 75 to the housing 38, the pressure inside the cryopump 10 can be raised. The supplied purge gas is discharged from the cryopump 10 via the vent valve 70 or the rough valve 72.

According to the embodiment, the temperature of the purge gas is controlled to the room temperature. In alternative embodiments, the purge gas may be heated to a temperature higher than the room temperature or a temperature slightly lower than the room temperature. In this specification, the room temperature is defined to be a temperature selected from a range 10° C.-30° C. or a range 15° C.-25° C. For example, the room temperature may be 20° C. The purge gas is a nitrogen gas, for instance. The purge gas may be a dry gas.

The cryopump 10 includes a first temperature sensor 90 for measuring the temperature of the first stage 20 and a second temperature sensor 92 for measuring the temperature of the second stage 21. The first temperature sensor 90 is mounted to the first stage 20. The second temperature sensor 92 is mounted to the second stage 21. The first temperature sensor 90 measures the temperature of the first stage 20 periodically and outputs a signal indicating the measured temperature to the control unit 100. The first temperature sensor 90 is connected to the control unit 100 so that the output from the first temperature sensor 90 can be communicated to the control unit 100. The second temperature sensor 92 is configured similarly. Alternatively, the temperature measured by the first temperature sensor 90 may be used as indicating the temperature of the high-temperature cryopanel 19, and the temperature measured by the second temperature sensor 92 may be used as indicating the temperature of the low-temperature cryopanel 18.

A pressure sensor 94 is provided inside the housing 38. The pressure sensor 94 is located outside the high-temperature cryopanel 19 and is provided near the refrigerator 16, for instance. The pressure sensor 94 measures the pressure within the housing 38 periodically and outputs a signal indicating the measured pressure to a control unit 100. The pressure sensor 94 is connected to the control unit 100 so that the signal outputted from the pressure sensor 94 can be supplied to the control unit 100.

The cryopump 10 includes the control unit 100 for controlling the cryopump 10. The control unit 100 may be provided integrally with the cryopump 10 or may be configured as a controller separate from the cryopump 10.

The control unit 100 is so configured as to control the refrigerator 16 to carry out a vacuum pumping operation and a regeneration operation of the cryopump 10. The control unit 100 is configured such that the measurement results of various sensors such as the first temperature sensor 90, the second temperature sensor 92 and the pressure sensor 94 can be received. Based on those measurement results, the control unit 100 computes instructions given to the refrigerator 16 and the valves.

In the vacuum pumping operation, the control unit 100 controls the refrigerator 16 in such a manner, for example, that a stage temperature (e.g., first-stage temperature) follows a target cooling temperature. The target temperature of the first stage 20 is typically set to a constant value. The target temperature of the first stage 20 is determined to be a certain value as specifications according to a process performed in the vacuum chamber attached to the cryopump 10. The control unit 100 is configured to control gas evacuation from the housing 38 and supply of the purge gas to the housing 38 for regeneration of the cryopump 10. The control unit 100 controls the opening and closing of the vent valve 70, the rough valve 72 and the purge valve 74 during regeneration.

An operation of the cryopump 10 configured as above is now explained hereunder. As the cryopump 10 is to be operated, the interior of the cryopump 10 is first roughly evacuated to an operation start pressure (e.g., about 1 Pa-10 Pa) by using the roughing pump 73 through the rough valve 72 before the operation starts. Then the cryopump 10 is operated. The first stage 20 and the second stage 21 are cooled under the control of the control unit 100 by driving the refrigerator 16. This also cools the high-temperature cryopanel 19 and the low-temperature cryopanel 18 that are thermally coupled to the first stage 20 and the second stage 21, respectively.

The inlet cryopanel 32 cools gases coming from the vacuum chamber into the cryopump 10 and condenses a gas, whose vapor pressure gets sufficiently low by this cooling temperature (e.g., water or the like), on the surface of the inlet cryopanel 32 so that the gas is removed from the vacuum chamber. On the other hand, gases, whose vapor pressure does not become sufficiently low by the cooling temperature of the inlet cryopanel 32, passes through the inlet cryopanel 32 and enters inside the radiation shield 30. Of the gases that have entered inside the radiation shield 30, a gas whose vapor pressure becomes sufficiently low by the cooling temperature of the low-temperature cryopanel 18 is condensed for removal on a surface of the low-temperature cryopanel 18. Gases, whose vapor pressure does not become sufficiently low even by the cooling temperature of the low-temperature cryopanel 18 (e.g., hydrogen or the like), is adsorbed for removal by an adsorbent 27 adhered to the surface of the low-temperature cryopanel 18. In this manner, the cryopump 10 can attain a desired degree of vacuum in the vacuum chamber attached to the cryopump 10.

As the pumping operation continues, the gases are accumulated in the cryopump 10. In order that the accumulated gases can be discharged to the outside, the cryopump 10 is regenerated. A regeneration cycle includes a temperature-raising process, a discharging process, and a cool down process.

The regeneration process of the cryopump 10 is controlled by the control unit 100. The control unit 100 determines whether a predetermined regeneration-start condition is satisfied, and starts the regeneration if the condition is satisfied. If the condition is not satisfied, the control unit 100 will not start the regeneration and continue the vacuum pumping operation. The regeneration-start condition may include a condition where a predetermined length of time has elapsed after the start of the pumping operation, for instance.

Figure 2:
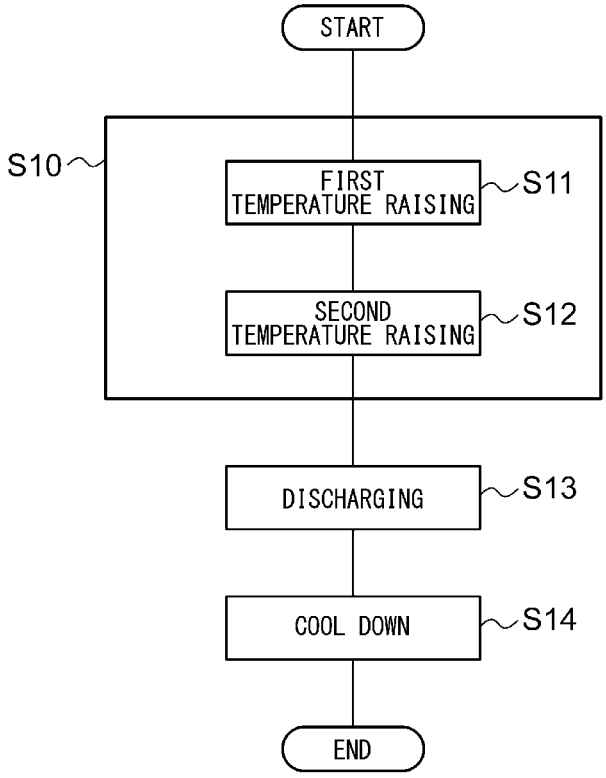
FIG. 2 a flowchart to explain a regeneration method according to an embodiment of the present invention.

FIG. 2 is a flowchart to explain a regeneration method according to an embodiment of the present invention. The regeneration includes the temperature-raising process or step of raising the temperature of the cryopump 10 to a regeneration temperature, which is higher than the temperature of the cryopanel during the pumping operation (S10). The exemplary regeneration process shown in FIG. 2 is a so-called "full regeneration". The full regeneration regenerates all cryopanels including the high-temperature cryopanel 19 and the low-temperature cryopanel 18. The cryopanels 18 and 19 are heated starting from the cooling temperature required for the vacuum pumping operation up to the regeneration temperature. The regeneration temperature may be the room temperature or a slightly higher temperature.

In the temperature-raising process, the purge gas is used as the first heat source for heating the cryopanels 18 and 19. The control unit 100 determines whether a purge-start condition is met. If the purge-start condition is met, the control unit 100 opens the purge valve 74 so as to supply the purge gas to the housing 38. The purge start condition may be the regeneration-start condition. In other words, the purge gas is started to be supplied concurrently with the start of regeneration. The control unit 100 also determines whether a purge-suspension condition is met. If the purge-suspension condition is met, the control unit 100 closes the purge valve 74 so as to stop supplying the purge gas to the housing 38.

The second heat source different from the purge gas may be used to heat the cryopanels 18 and 19. For example, the temperature-raising operation (so-called reversal heating) of the refrigerator 16 may be performed. The refrigerator 16 is configured such that the operating gas undergoes adiabatic compression when the drive mechanism 17 operates in a direction opposite to that of the cooling operation. The refrigerator 16 heats the first stage 20 and the second stage 21 with the obtained compression heat. The high-temperature cryopanel 19 is heated by the first stage 20 as the heat source, and the low-temperature cryopanel 18 is heated by the second stage 21 as the heat source. Alternatively, a heater provided in the refrigerator 16 may be used as the heat source. In this case, the control unit 100 can control the heater independent of the operation of the refrigerator 16.

In the temperature-raising process, one of the first and second heat sources may be used alone. Alternatively, the two heat sources may be used at the same time. In the discharging process, as in the temperature-raising process, one of the first and second heat sources may be used alone or both may be used at the same time. The control unit 100 switches between the first and second heat sources or uses the first and second heat sources in conjunction so as to control the temperature of the cryopanels 18 and 19.

As shown in FIG. 2, the temperature-raising process includes the first temperature-raising process (S11) and the second temperature-raising process (S12). The control unit 100 is configured to perform the first temperature-raising process and the second temperature-raising process in succession so as to heat the cryopanels 18 and 19 from the cooling temperature required for the vacuum pumping operation to a target heating temperature higher than the room temperature. For example, the target temperature is a temperature selected from a range 30° C.-60° C. or a range 40° C.-50° C.

In the first temperature-raising process, the cryopanels 18 and 19 are heated to the first temperature zone. Subsequently, the cryopanels 18 and 19 are heated in the second temperature-raising process to the second temperature zone higher than the first temperature zone.

The first temperature zone is a temperature range including the purge gas temperature (e.g., the room temperature, as described above). The first temperature zone defines temperatures at which the ice collected on the cryopanels 18 and 19 is melted and turned into water. For example, the lower limit of the first temperature zone is the melting point of water (i.e., about 0° C.) and the upper limit thereof is the purge gas temperature. For example, the first temperature zone is a range 10° C.-30° C. or a range 15° C.-25° C.

The second temperature zone is a temperature range including the target temperature to which the cryopanels are heated. For example, the lower limit of the second temperature zone is the purge gas temperature and the upper limit thereof is the target temperature. For example, the second temperature zone is a range 30° C.-60° C. or a range 40° C.-50° C. The second temperature zone is lower than the temperature of the heat source (e.g., the first stage 20 and the second stage 21 in the temperature-raising operation of the refrigerator 16).

The first temperature-raising process includes supplying the purge gas to the cryopump in order to heat the cryopanels 18 and 19 from the cooling temperature required for the vacuum pumping operation to the first temperature zone. The first temperature-raising process also includes reversal heating by the refrigerator 16. In this way, the purge gas and the refrigerator 16 are used in conjunction as the heat sources to raise the temperature of the cryopanels 18 and 19 at a high speed in the first temperature raising process. The cryopanels 18 and 19 are heated by heat conduction from the first stage 20 and the second stage 21 and by heat transfer by convection of the purge gas.

The control unit 100 periodically determines whether the purge-suspension condition is met during the first temperature-raising process. If the purge-suspension condition is not met, the control unit 100 continues the first temperature raising process. If the purge-suspension condition is met, the control unit 100 terminates the first temperature raising process and starts the second temperature raising process.

An exemplary purge-suspension condition in the first temperature raising process may require that the cryopanel temperature (e.g., the temperature measured by the first temperature sensor 90 and/or the second temperature sensor 92) is in the first temperature zone. In this case, the control unit 100 determines whether the cryopanel temperature is in the first temperature zone. If the cryopanel temperature is in the first temperature zone, the control unit 100 closes the purge valve 74 to suspend the supply of the purge gas to the housing 38 and induce transition from the first temperature raising process to the second temperature raising process.

If the temperature measured by the first temperature sensor 90 and/or the second temperature sensor 92 is determined to be in the first temperature zone, the control unit 100 may continue supplying the purge gas for a predetermined period of time (so-called extended purge). The supply of the purge gas to the housing 38 may be stopped when uniform surface temperature distribution on the cryopanels 18 and 19 in the first temperature zone is ensured.

In this regard, the purge-suspension condition in the first temperature-raising process may be the elapse of a predetermined period of time since the start of the first temperature raising process. The predetermined period of time is a period of time expected to be necessary to heat the cryopanels 18 and 19 to the first temperature zone and may be predefined experimentally or empirically as appropriate.

The first temperature raising process may include stopping the supply of the purge gas. A period of time in which the purge gas is not temporarily supplied may be provided while the cryopanels 18 and 19 are heated from the ultracold temperature to the first temperature zone. For example, the supply of the purge gas may be temporarily stopped for safety when an extremely high internal pressure is built up in the housing 38 due to re-vaporization of the frozen gas collected on the cryopanels 18 and 19.

The second temperature raising process includes heating the cryopanels 18 and 19 from the first temperature zone to the second temperature zone by a heat source different from the purge gas. For example, the second temperature raising process may include continuing the reversal heating in the first temperature raising process using the refrigerator 16. This ensures that the cryopanels 18 and 19 are heated in the second temperature raising process by heat conduction from the first stage 20 and the second stage 21.

In a typical method of regenerating a cryopanel, the purge gas continues to be supplied until the temperature of the cryopanels is raised to a target temperature. It should be noted here that the target temperature is higher than the purge gas in this embodiment. Therefore, heat transfer by convection of the purge gas has an effect of depriving the cryopanels of heat at the target temperature. In other words, as the cryopanels are heated by the second heat source to a temperature higher than the purge gas temperature, the cryopump is adversely cooled by the purge gas. This extends the time required to heat the cryopanels to the target temperature. In the worst case, the target temperature cannot be reached.

In the second temperature raising process according to the embodiment, the supply of the purge gas is suspended. Therefore, the cooling effect due to the supply of the purge gas is mitigated by the embodiment as compared to the typical method described above. Accordingly, the cryopump 10 can be heated to the target temperature in a short period of time.

Preferably, rough evacuation of the cryopump 10 may be performed while the cryopanels 18 and 19 are heated from the first temperature zone to the second temperature zone. The control unit 100 may temporarily open the rough valve 72 in the second temperature raising process so as to roughly evacuate the housing 38. This discharges the purge gas from the cryopump 10 and prevents heat transfer by convection of the purge gas. Accordingly, the temperature of the cryopanels 18 and 19 can be raised more efficiently.

A purpose of rough evacuation or rough pumping in the temperature raising process is to prevent heat transfer by convection of the purge gas. Therefore, it is sufficient that a certain negative pressure is produced in the housing 38 by rough evacuation. In other words, not so high degree of vacuum is required in rough evacuation in the temperature raising process. Therefore, the roughing pressure in the temperature raising process may be higher than the roughing pressure in the discharging process. The term "roughing pressure" means a pressure at which rough evacuation is terminated. For the same reason, a period of time for which the rough valve 72 is opened in the temperature raising process may be shorter than a period of time for which the rough valve 72 is opened in the discharging process.

The cryopump 10 captures water and other gases through the vacuum pumping operation. In general applications of the cryopump 10, water is a gas with the highest melting point and so is a gas most difficult to discharge. The frozen gas other than water has a melting point significantly lower than that of water and so can be easily discharged from the cryopump 10. Extraneous materials attached to the cryopanels 18 and 19 originating from vacuum grease or resist are evaporated in the high-temperature low-pressure environment.

It is therefore possible to substantially discharge all types of gas other than water from the cryopump 10 by rough evacuation in the temperature raising process. In this case, the supply of the purge gas may be resumed in the second temperature raising process in order to increase the cleanness in the cryopump 10. In this regard, so-called rough and purge may be performed while the cryopanels 18 and 19 are heated from the first temperature zone to the second temperature zone. The rough and purge in the temperature raising process may be referred to as "temperature raising rough and purge" in this specification.

The rough and purge is a process in which rough evacuation of the housing 38 through the rough valve 72 and the supply of the purge gas are performed alternately. In the rough and purge, a combination of roughing and purging is performed once or a plurality of times. In the rough and purge, the control unit 100 normally performs roughing or purging selectively. In other words, while roughing (or purge) is performed, purge (or roughing) is suspended. The rough and purge may be started and terminated in accordance with the pressure in the housing 38 or an elapsed time.

Alternatively, the rough and purge may be performed such that while one of roughing and purging is being performed continuously, the other of roughing and purging may be performed intermittently. This is also seen as being equivalent to roughing and supply of the purge being performed alternately. The rough and purge cycle may include a period of time in which neither roughing nor purge is performed.

The control unit 100 periodically determines whether a temperature raising completion condition is met in the second temperature raising process. If the temperature raising completion condition is not met, the control unit 100 continues the second temperature raising process. If the temperature raising completion condition is met, the control unit 100 terminates the second temperature raising process and starts the discharging process.

The temperature raising completion condition may require that the cryopanel temperature (e.g., the temperature measured by the first temperature sensor 90 and/or the second temperature sensor 92) is in the second temperature zone. In this case, the control unit 100 determines whether the cryopanel temperature is in the second temperature zone. If the cryopanel temperature is in the second temperature zone, the control unit 100 induces transition from the temperature raising process to the discharging process. The control unit 100 may determine whether the cryopanel temperature exceeds the target temperature and, if the cryopanel temperature exceeds the target temperature, the control unit 100 may induce transition from the temperature raising process to the discharging process.

Alternatively, the temperature raising process completion condition may require that a predetermined period of time has elapsed since the start of the first temperature raising process or the second temperature raising process. The predetermined period of time is a period of time expected to be necessary to heat the cryopanels 18 and 19 to the second temperature zone (e.g., the target temperature) and may be predefined experimentally or empirically as appropriate.

The temperature raising completion condition may be dependent on the pressure in the housing 38. For example, the control unit 100 may determine whether the pressure drop rate during rough evacuation in the temperature raising rough and purge exceeds a threshold value. The control unit 100 may induce transition from the temperature raising process to the discharging process if the pressure drop rate exceeds the threshold value and continue the temperature raising rough and purge if the pressure drop rate is below the threshold value.

When the temperature raising process is completed, the control unit 100 starts the discharging process (S13). In the discharging process, the gas re-vaporized from the surface of the cryopanels is discharged outside the cryopump 10. The re-vaporized gas is discharged outside via the exhaust line 80 or by using the roughing pump 73, for instance. The re-vaporized gas is discharged, together with the purge gas introduced, from the cryopump 10 as necessary. For example, water evaporates from the cryopanels 18 and 19 and water is discharged from the housing 38.

The control unit 100 may control the temperature raising operation of the refrigerator 16 or control another heat source so as to maintain the cryopanel temperature in the second temperature zone in the discharging process. In this case, the control unit 100 may suspend the heat source at least temporarily in order to avoid excessive heating.

Figure 4:
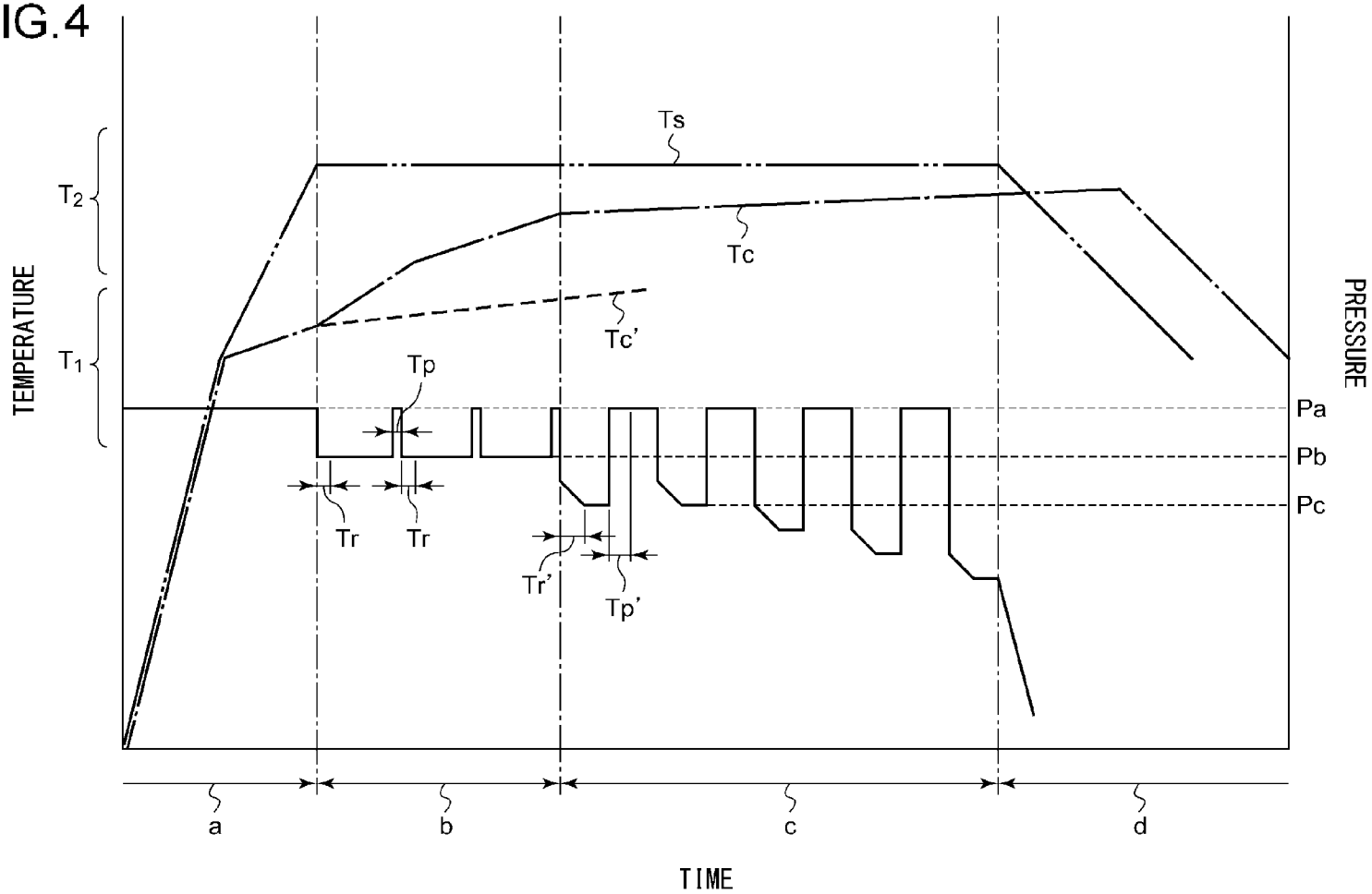
FIG. 4 is a graph showing a regeneration sequence according to an embodiment of the present invention.

So-called rough and purge may be performed in the discharging process. Rough and purge in the discharging process may be referred to as "discharging rough and purge" in this specification. The control unit 100 may perform discharging rough and purge in which rough evacuation of the housing 38 and the supply of the purge gas are alternated, while the cryopanel temperature is in the second temperature zone. Therefore, the control unit 100 may induce transition from the temperature raising rough and purge to the discharging rough and purge if the temperature raising completion condition is met, as shown in FIG. 4.

The roughing pressure in the discharging rough and purge is higher than the base pressure zone. For example, the roughing pressure is selected from a range of 50 Pa-500 Pa or, preferably, 100 Pa-200 Pa. Hereinafter, a pressure region in this pressure range will be referred to as "sub-base pressure zone". The roughing pressure in the discharging rough and purge may remain constant during the discharging process. However, the roughing pressure in the discharging rough and purge may be reduced stepwise in alternative embodiments.

The discharging rough and purge is performed to discharge water from the cryopump 10 efficiently. In contrast, the main purpose of the temperature raising rough and purge is to raise the temperature of the cryopump 10 efficiently and to discharge gases other than water. For efficient temperature raising, it is preferable to restrict the supply of the purge gas. In this regard, the interval between purges in the temperature raising rough and purge is preferably longer than the interval between purges in the discharging rough and purge. For the same reason, the purge time in the temperature raising rough and purge is preferably shorter than the purge time in the discharging rough and purge. The purge interval is defined as a period of time elapsed since the end of the previous purge until the start of the current purge. The purge time is defined as a period of time for which the current purge continues.

Gases other than water are discharged relatively easily. Therefore, the roughing time in the temperature raising rough and purge may be shorter than the roughing time in the discharging rough and purge. Further, the roughing interval in the temperature raising rough and purge may be longer than the roughing interval in the discharging rough and purge. The roughing interval is defined as a period of time elapsed since the end of the previous rough until the start of current rough. The roughing time is defined as a period of time for which the current rough continues.

The control unit 100 determines whether the gas (i.e., the water vapor) has been discharged based on, for example, the measurements of the pressure sensor 94. For example, the control unit 100 may continue the discharging process if the pressure in the cryopump 10 exceeds a predetermined threshold value. The control unit 100 may terminate the discharging process and start a cool down process if the pressure falls below the threshold value.

The control unit 100 may use a so-called buildup test. The buildup test in the cryopump regeneration is a process to determine that the gas is properly discharged from the cryopump 10 if the pressure rise slope from the initial pressure at the start of the test does not exceed a threshold for the test.

The cool down process (S14) is a process to cool the cryopanels 18 and 19 again in order to resume the vacuum pumping operation. The cooling operation of the refrigerator 16 is started. Roughing may be performed in at least a part of the cooling process. For example, roughing may be continued since the start of cooling until the roughing termination pressure or the roughing termination temperature is reached. The control unit 100 determines whether the cryopanels are cooled to the cooling temperature defined for the vacuum pumping operation. The control unit 100 continues the cool down process until the target cooling temperature is reached and terminates the cool down process when the target temperature is reached. This completes the regeneration process. The vacuum pumping operation of the cryopump 10 is resumed.

Figure 3:
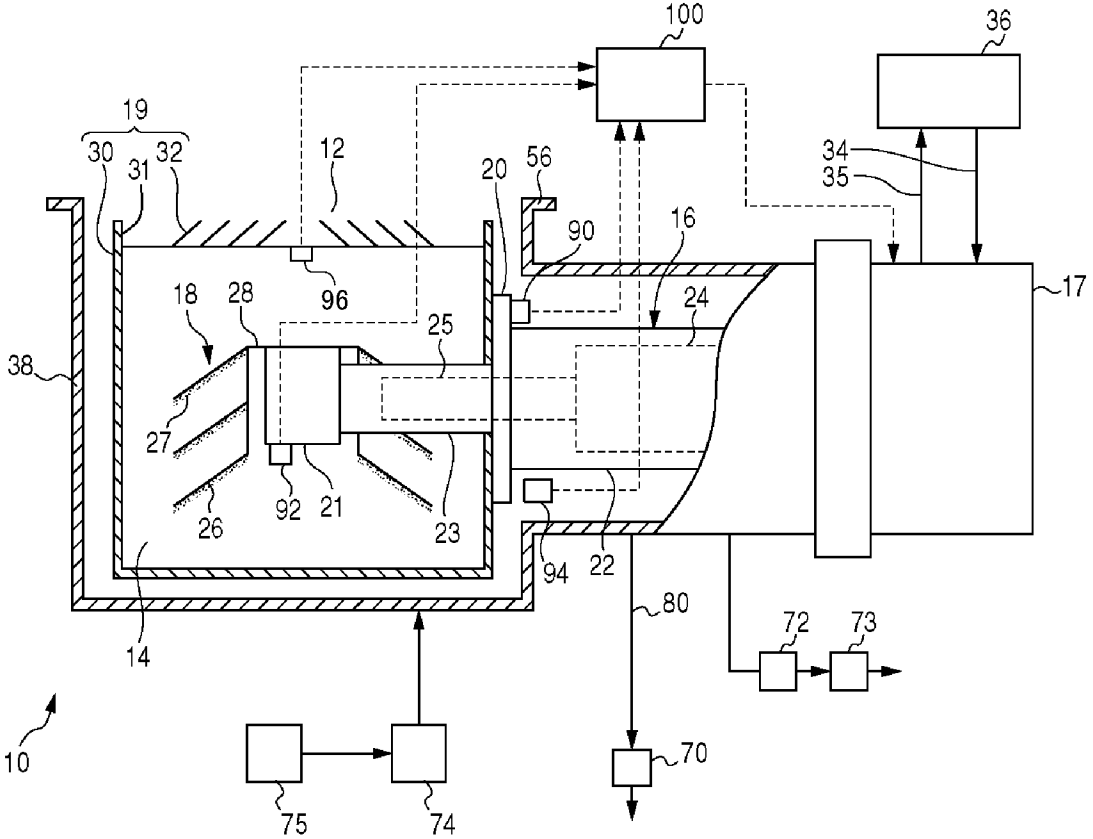
FIG. 3 is a schematic diagram showing a cryopump according to an embodiment of the present invention.

FIG. 3 schematically shows the cryopump 10 according to an embodiment of the present invention. In certain embodiments, a temperature sensor may be provided with the cryopanel in order to measure the temperature of the cryopanel directly. For example, a panel temperature sensor 96 may be provided at the center of the inlet cryopanel 32, as shown in FIG. 3. The panel temperature sensor 96 measures the temperature of the inlet cryopanel 32 periodically and outputs a signal indicating the measured temperature to the control unit 100. The panel temperature sensor 96 is connected to the control unit 100 so that the output from the panel temperature sensor 96 can be communicated to the control unit 100.

The center of the inlet cryopanel 32 is the part of the cryopanel farthest from the heat source for heating the cryopump 10 during regeneration. Therefore, it takes more time to raise the temperature of the center of the inlet cryopanel 32 than elsewhere. In other words, when the center of the inlet cryopanel 32 is heated to the target temperature, the temperature of the other parts of the cryopanel will have been sufficiently raised. Therefore, the temperature of the center of the inlet cryopanel 32 properly represents the temperature of the cryopanel as a whole in the temperature raising process for regeneration.

The panel temperature sensor 96 may be provided at the end of the heat transfer path in the low-temperature cryopanel 18 or the high-temperature cryopanel 19. The term "end of the heat transfer path" means a place in the cryopanel away from the heat source during temperature raising. For example, the high-temperature cryopanel 19 can be segmented into a region near the heat source (i.e., having a shorter heat transfer path) and a region far from the heat source (i.e., having a longer heat transfer path) depending on the length of heat transfer path from the heat source to a given point on the panel. Alternatively, the high-temperature cryopanel 19 can be similarly segmented into three regions including a region near the heat source, an intermediate region, and a region far from the heat source. The low-temperature cryopanel 18 may be segmented similarly. The region far from the heat source may be defined as the end of the heat transfer path.

Therefore, the panel temperature sensor 96 may be provided at the shield open end 31 or the closed end of the radiation shield 30. Still alternatively, the panel temperature sensor 96 may be provided at the end of the panel member 26 of the low-temperature cryopanel 18 farthest from the second stage 21.

The panel temperature sensor 96 is used to monitor the temperature of the cryopanel being regenerated. The panel temperature sensor 96 has a measurable temperature range including the target temperature in the temperature raising process. In this embodiment, the panel temperature sensor 96 is not used during vacuum pumping. Therefore, the panel temperature sensor 96 may not include ultracold temperatures in its measurable temperature range. In essence, the panel temperature sensor 96 may be able to measure a room temperature level (e.g., 0° C.-60° C.). Accordingly, an inexpensive thermocouple may be used as the panel temperature sensor 96.

FIG. 4 is a diagram showing a regeneration sequence according to an embodiment of the present invention. The regeneration sequence is controlled by the control unit 100 as described above. FIG. 4 schematically shows exemplary changes with time in temperature and pressure during a regeneration of the cryopump 10. The temperatures shown in FIG. 4 are those measured by the first temperature sensor 90 and the panel temperature sensor 96, and the pressures are those measured by the pressure sensor 94.

The entire period of regeneration sequence from start to finish, as shown in FIG. 4, is divided into four periods, i.e., period a to period d. Period a corresponds to the above-described first temperature-raising process, period b to the second temperature raising process, period c to the discharging process, and period d to the cooling process.

In period a, the purge valve 74 is opened and the reversal heating by the refrigerator 16 is performed. Through the reversal heating by the refrigerator 16 and nitrogen purge, the cryopump 10 is heated to the first temperature zone T1. The temperature of the nitrogen gas is about 20° C. In the first half of the first temperature raising process, the stage temperature Ts and the cryopanel temperature Tc rise by displaying similar slopes. In the second half of the first temperature raising process, the slope of the cryopanel temperature Tc is gentler than that of the stage temperature Ts. The stage temperature Ts represents the temperature of the first stage 20, and the cryopanel temperature Tc represents the temperature at the center of the inlet cryopanel 32.

As a result of the nitrogen purge, the pressure inside the cryopump reaches the atmospheric pressure Pa quickly. A majority of the gas other than water is released from the cryopanels 18 and 19 into the housing 38 while the temperature is being raised. In this example, when the stage temperature Ts reaches a target value, the first temperature raising process is terminated and the second temperature raising process is started.

At a point of time that period b is started, the purge valve 74 is closed and nitrogen purge is suspended, but reversal heating by the refrigerator 16 is continued so that the stage temperature Ts is maintained at a target value. This raises the cryopanel temperature Tc from the first temperature zone T1 to the second temperature zone T2.

Concurrently with the closure of the purge valve 74 at the start of period b, the rough valve 72 is temporarily opened.

This discharges the nitrogen gas and the gas released from the cryopanels 18 and 19. The rough valve 72 is closed when the roughing time Tr elapses. The internal pressure in the cryopump 10 is decreased to the roughing pressure Pb. This promotes temperature raising of the cryopanels 18 and 19. For comparison, the cryopanel temperature Tc' that would occur if nitrogen purge is continued in period b is indicated by a broken line in FIG. 4. The cryopanel temperature Tc' is not increased so much due to the cooling effect by the nitrogen gas.

In the second temperature raising process, temperature raising rough and purge is performed. The purge valve 74 is temporarily opened for nitrogen purge. The purge valve 74 is closed when the purge time Tp elapses. The pressure returns to the atmospheric pressure Pa. Concurrently with the closure of the purge valve 74, the rough valve 72 is opened so that the internal pressure is decreased again to the roughing pressure Pb. The pressure drop rate is measured during the roughing operation. As shown in FIG. 4, nitrogen purge and roughing are performed alternately, three time each, in this example. The pressure drop rate exceeds the threshold value in the roughing operation immediately after the third nitrogen purge so that transition from the temperature raising rough and purge to the discharging rough and purge is induced.

In period c, water is discharged from the cryopump 10 by the discharging rough and purge. During the discharging rough and purge, the cryopanel temperature Tc increases slightly but gradually in the second temperature zone T2.

The purge time Tp' and the roughing time Tr' in the discharging rough and purge are longer than the purge time Tp and the roughing time Tr in the temperature raising rough and purge, respectively. The roughing pressure Pc in the discharging rough and purge is at the base pressure zone or the sub-base pressure zone and is lower than the roughing pressure Pb in the temperature raising rough and purge. In this example, the roughing pressure Pc in the first half of the discharging rough and purge is at the sub-base pressure zone, and the roughing pressure in the second half of the discharging rough and purge is at the base pressure zone.

The buildup test is done after the rough pumping at least in the second half of the discharging rough and purge. The rough pumping is suspended during the test. If the buildup test is passed (i.e., if the pressure rise slope is smaller than the threshold value), the discharging process is terminated.

In period d, the cooling operation of the refrigerator 16 is started. Roughing is also performed. When the target cooling temperature is reached, roughing is terminated. This completes regeneration and a vacuum pumping operation is started.

As described above, according to the embodiment, nitrogen purge is suspended and vacuum pumping is performed in the interior of the cryopump, when the cryopump temperature approximately reaches the room temperature in the temperature raising process for cryopump regeneration. In this way, the temperature of the cryopanels is raised efficiently. Another advantage is that the temperature of the cryopanels is raised to a higher level than otherwise. In this way, the time required for regeneration of the cryopump can be reduced.

Described above is an explanation based on an exemplary embodiment. The invention is not limited to the embodiment described above and it will be obvious to those skilled in the art that various design changes and variations are possible and that such modifications are also within the scope of the present invention.

For example, rough and purge is performed in the discharging process according to the embodiment. However, the mode of the discharging process is non-limiting. In an alternative embodiment, the purge gas may not be supplied in the discharging process. In this case, the control unit 100 may control the rough valve 72 and the roughing pump 73 so as to roughly evacuate the cryopump 10 to a predetermined roughing pressure (e.g., the base pressure zone) after the temperature raising process is completed. The control unit 100 may then determine (e.g., buildup test) whether the gas has been discharged, based on the measurements of the pressure sensor 94.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryopanel;

a temperature sensor that measures a temperature of the cryopanel;

a refrigerator thermally connected to the cryopanel;

a cryopump housing arranged to enclose the cryopanel;

a purge valve connected to the cryopump housing to supply a purge gas to the cryopump housing;

a heat source that heats the cryopanel, the heat source being different from the purge gas; and a controller communicably connected to the temperature sensor and the refrigerator, the controller using signals to control regeneration of the cryopump, the regeneration including a temperature-raising process and a discharging process subsequent to the temperature-raising process, wherein the controller is configured to successively perform a first temperature-raising and a second subsequent temperature-raising during the temperature-raising process, the first temperature-raising to heat the cryopanel to a first temperature zone higher than the melting point of water, the second subsequent temperature-raising to heat the cryopanel from the first temperature zone to a second temperature zone higher than a purge gas temperature, during the first temperature-raising, the controller opens the purge valve to supply the purge gas to the cryopump housing in order to heat the cryopanel to the first temperature zone higher than the melting point of water, during the first temperature-raising, the controller closes the purge valve to suspend supply of the purge gas to the cryopump housing while a cryopanel temperature is in the first temperature zone, during the second subsequent temperature-raising, the controller controls the heat source to heat the cryopanel from the first temperature zone to the second temperature zone higher than the purge gas temperature, the controller is configured to determine whether a temperature raising completion condition is met during the second subsequent temperature-raising, and the controller is configured to start the discharging process of the regeneration when the temperature raising completion condition is met.

2. The cryopump according to claim 1, further comprising:

a rough valve connected to the cryopump housing in order to rough the cryopump housing, wherein during the second subsequent temperature-raising, the controller opens the rough valve to rough the cryopump housing while the cryopanel is heated from the first temperature zone to the second temperature zone.

3. The cryopump according to claim 2, wherein during the second subsequent temperature-raising, the controller performs a temperature-raising rough-and-purge in which rough evacuation of the cryopump housing and supply of the purge gas are alternately performed while the cryopanel is heated from the first temperature zone to the second temperature zone, and during the discharging process, the controller performs a discharging rough-and-purge in which rough evacuation of the cryopump housing and supply of the purge gas are alternately performed while the cryopanel temperature is in the second temperature zone.

4. The cryopump according to claim 3, wherein an interval between purges in the temperature-raising rough-and-purge is longer than an interval between purges in the discharging rough-and-purge, and/or, a purge time in the temperature-raising rough-and-purge is shorter than a purge time in the discharging rough-and-purge.

5. The cryopump according to claim 3, wherein a roughing pressure in the temperature-raising rough-and-purge is higher than a roughing pressure in the discharging rough-and-purge.

6. The cryopump according to claim 1, wherein the refrigerator includes a first stage and a second stage cooled to a temperature lower than that of the first stage;

the cryopanel includes a high-temperature cryopanel cooled by the first stage and a low-temperature cooled by the second stage, the low-temperature cryopanel includes a radiation shield enclosing the low-temperature cryopanel and provided with a shield open end, and an inlet cryopanel disposed on the shield open end, and the temperature sensor is provided at a center part of the inlet cryopanel.

7. The cryopump according to claim 1, wherein the purge gas temperature is a room temperature.

8. The cryopump according to claim 1, wherein a target heating temperature in the second temperature zone is a temperature selected from a range 30° C.-60° C.

9. A method of regenerating the cryopump according to claim 1, comprising:

supplying the purge gas to the cryopump housing;

heating the cryopanel to the first temperature zone;

suspending supply of the purge gas to the cryopump housing while the cryopanel is in the first temperature zone, and heating the cryopanel from the first temperature zone to the second temperature zone.

10. The method according to claim 9, further comprising:

roughing the cryopump while the cryopanel is heated from the first temperature zone to the second temperature zone.

11. The method according to claim 9, further comprising:

discharging water from the cryopump while the cryopanel is in the second temperature zone.

* * * * *